US012287176B2

(12) United States Patent
Lee et al.

(10) Patent No.: US 12,287,176 B2
(45) Date of Patent: Apr. 29, 2025

(54) FIREARM OPTICS MOUNT PLATE WITH MULTIPLE FOOTPRINTS

(71) Applicant: Strike IP, LLC, Las Vegas, NV (US)

(72) Inventors: Shanyao Lee, Las Vegas, NV (US); Hung-Ju Lee, Las Vegas, NV (US)

(73) Assignee: Strike IP, LLC, Las Vegas, NV (US)

( * ) Notice: Subject to any disclaimer, the term of this patent is extended or adjusted under 35 U.S.C. 154(b) by 189 days.

(21) Appl. No.: 18/131,408

(22) Filed: Apr. 6, 2023

(65) Prior Publication Data

US 2023/0341213 A1 Oct. 26, 2023

Related U.S. Application Data

(60) Provisional application No. 63/335,117, filed on Apr. 26, 2022.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 2,116,618 A * 5/1938 Crockett ..... F41C 23/02 42/71.01
4,021,954 A * 5/1977 Crawford ..... F41G 11/003 42/127
7,954,270 B2 * 6/2011 Bentley ..... F41G 11/003 42/72
8,807,496 B2 * 8/2014 Kessler ..... F16M 11/041 396/428
8,827,219 B2 * 9/2014 Kessler ..... F16M 11/041 396/428
10,648,776 B2 * 5/2020 Galli ..... F41G 11/003
10,655,929 B2 * 5/2020 Stewart ..... F41C 27/00
10,942,009 B2 * 3/2021 Galli ..... F41G 1/35
11,118,868 B2 * 9/2021 Banes ..... F41A 23/14
11,150,049 B2 * 10/2021 Kennair, Jr. ..... F41G 11/003
11,181,338 B2 * 11/2021 Kennair, Jr. ..... F41G 11/003
11,385,027 B2 * 7/2022 Galli ..... F41G 11/003
11,506,366 B2 * 11/2022 Sharrah ..... F41G 1/35
11,614,305 B2 * 3/2023 Galli ..... F41G 1/35 42/146

(Continued)

*Primary Examiner* — Michelle Clement
(74) *Attorney, Agent, or Firm* — Andy M. Han; Han IP PLLC

(57) ABSTRACT

A device implementable on a firearm includes a plate with a first primary side and a second primary side opposite the first primary side. When installed with the first primary side facing the firearm or an accessory of the firearm: (i) the first primary side is directly mounted on a portion of the firearm or the accessory, and (ii) the second primary side accommodates and mates with a first optic when the first optic is mounted on the second primary side of the plate. When installed with the second primary side facing the firearm or the accessory of the firearm: (i) the second primary side is directly mounted on the portion of the firearm or the accessory, and (ii) the first primary side accommodates and mates with a second optic different from the first optic when the second optic is mounted on the first primary side of the plate.

15 Claims, 10 Drawing Sheets

(56) References Cited

U.S. PATENT DOCUMENTS

| | | | | |
|---|---|---|---|---|
| 11,971,242 | B1 * | 4/2024 | Major | F41G 1/387 |
| 12,152,859 | B2 * | 11/2024 | Galli | F41G 1/35 |
| 2018/0164077 | A1 * | 6/2018 | Hancosky | F41G 11/003 |
| 2021/0254929 | A1 * | 8/2021 | Olheiser | F41G 11/001 |
| 2022/0357127 | A1 * | 11/2022 | Sun | G02B 27/20 |
| 2023/0194212 | A1 * | 6/2023 | Dardzinski | F41G 11/001 42/111 |
| 2023/0341213 | A1 * | 10/2023 | Lee | F41G 11/003 |
| 2023/0366657 | A1 * | 11/2023 | Tayon | F41G 1/35 |
| 2024/0401911 | A1 * | 12/2024 | Mize | F41G 1/387 |

* cited by examiner

FIREARM OPTICS MOUNT PLATE WITH MULTIPLE FOOTPRINTS

CROSS REFERENCE TO RELATED PATENT APPLICATION(S)

The present disclosure claims the priority benefit of U.S. Provisional Patent Application No. 63/335,117, filed 26 Apr. 2022, the content of which being herein incorporated by reference in its entirety.

TECHNICAL FIELD

The present disclosure is generally related to firearms and, more particularly, to a firearm optics mount plate with multiple footprints.

BACKGROUND

Unless otherwise indicated herein, approaches described in this section are not prior art to the claims listed below and are not admitted as prior art by inclusion in this section.

Optics, such as scopes, red dot sights, reflex sights and holographic sights, are tools or devices typically mounted on firearms to aid users of firearms to improve target placement and/or extend the visible range for aiming in operating firearms. Handgun optics, for example, allow users to extend the range at which the users can shoot with speed and precision. Due to differences in designs by different vendors, firearm optics typically come in different "footprint" patterns for mounting on firearms. However, this tends to cause a compatibility issue. For example, in order to mount an Aimpoint T-1™ sight on a Glock pistol slide, a user would need to purchase a converter or a new adaptor to fit the T-1 optics onto the slide of that pistol. When the user intends to mount different optics from different vendors on the same pistol, the user would likely need to purchase different convertors or adaptors to mount those different optics. This is costly and inconvenient from the user perspective. Therefore, there is a need for a solution of a firearm optics mount plate with multiple footprints.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issue, an objective of the present disclosure is to provide an innovative design of a firearm optics mount plate with multiple footprints. It is believed that a firearm optics mount plate with multiple footprints under various proposed schemes of the present disclosure may address or otherwise alleviate the aforementioned issues.

In one aspect, a device implementable on a plurality of firearms may include a plate with a first primary side and a second primary side opposite the first primary side. When installed in a first way with the first primary side facing the firearm or an accessory of the firearm: (i) the first primary side may be configured to be directly mounted on a portion of the firearm or the accessory, and (ii) the second primary side may be configured to accommodate and mate with a first optic when the first optic is mounted on the second primary side of the plate. When installed in second first way with the second primary side facing the firearm or the accessory of the firearm: (i) the second primary side may be configured to be directly mounted on the portion of the firearm or the accessory, and (ii) the first primary side may be configured to accommodate and mate with a second optic different from the first optic when the second optic is mounted on the first primary side of the plate.

In another aspect, a device implementable on a plurality of firearms (e.g., AR-style or AK-style rifles, carbines, pistols or shotguns) may include a plate with a first primary side and a second primary side opposite the first primary side. The first primary side may have a first footprint configured to accommodate and mate with a first optic. The second primary side may have a second footprint configured to accommodate and mate with a second optic. The first footprint and the second footprint may be different from each other.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
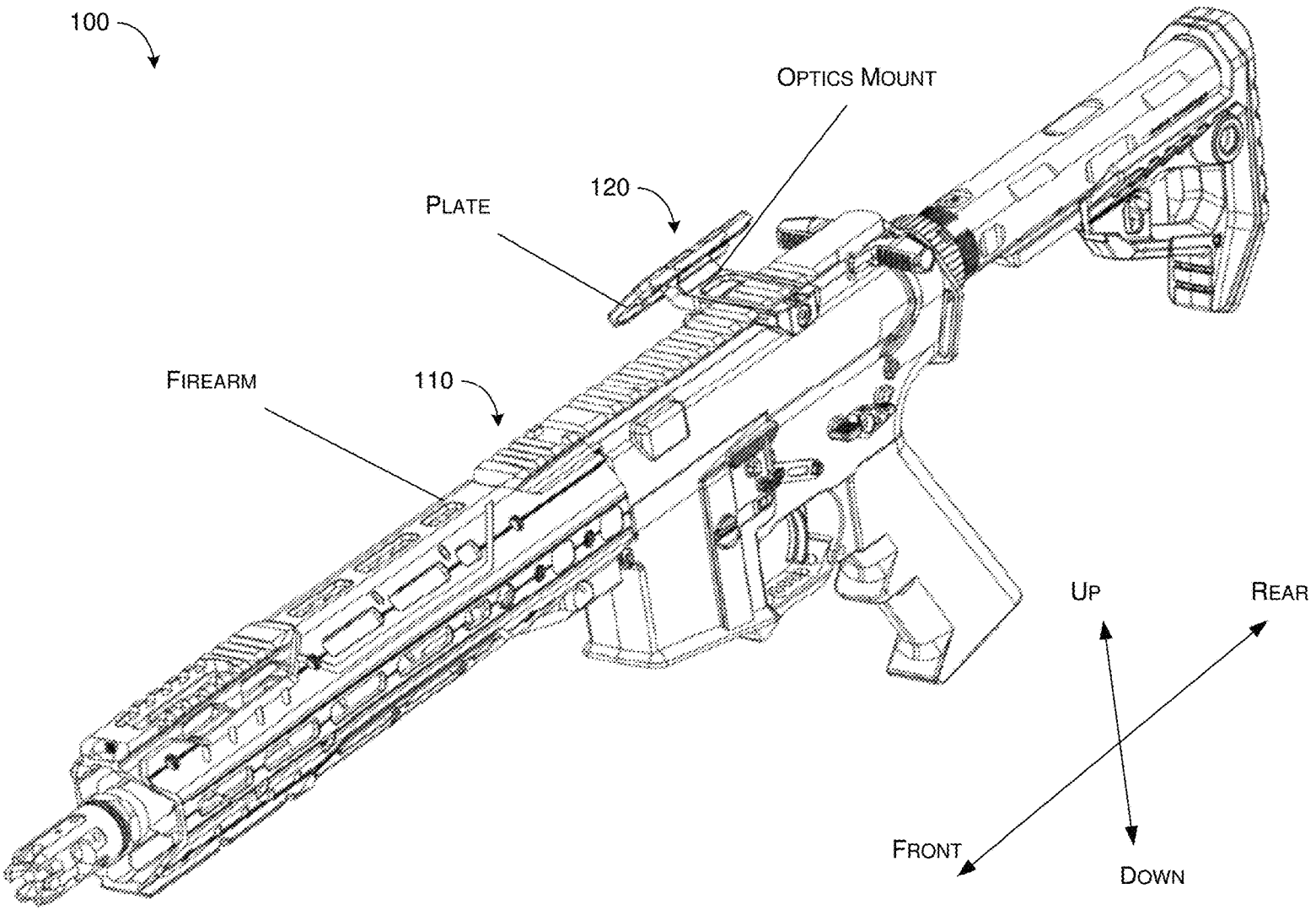
FIG. 1 is a diagram of an example implementation under a proposed scheme in accordance with the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g. 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

The following description is provided with reference to FIG. 1~FIG. 10 regarding a firearm optics mount plate with multiple footprints under various proposed schemes in accordance with the present disclosure for a firearm. In some implementations, the firearm may be a pistol, such as a semiautomatic pistol. In other implementations, the firearm may be an AR-style firearm or an AK-style firearm, which may be a rifle, carbine, pistol or shotgun.

Figure 2:
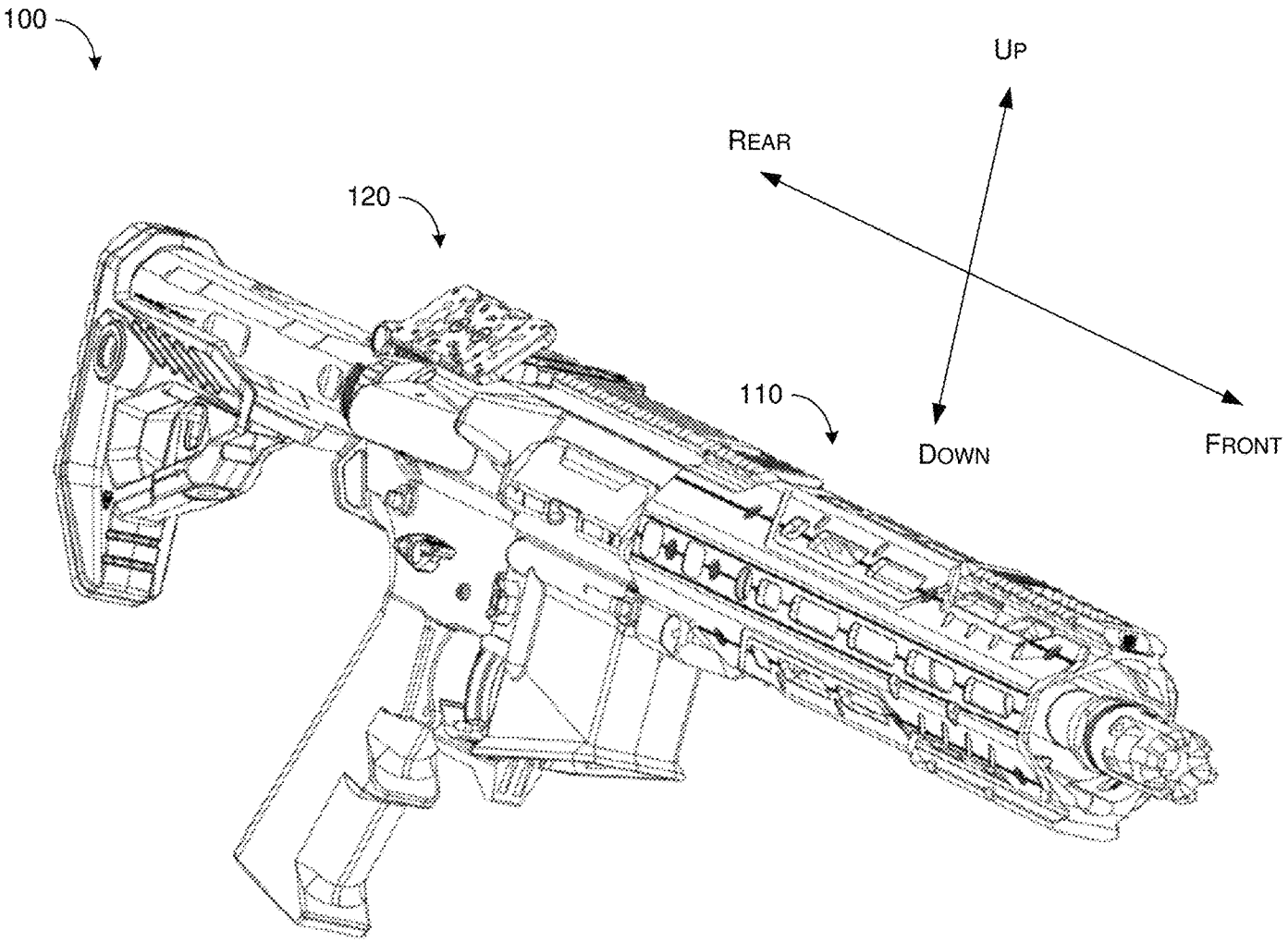
FIG. 2 is a diagram of an example implementation under a proposed scheme in accordance with the present disclosure.

Each of FIG. 1 and FIG. 2 illustrates an example implementation under a proposed scheme in accordance with the present disclosure. Referring to FIG. 1 and FIG. 2, an apparatus 100 may include a firearm 110 and an optics mount 120. The options mount 120 may be mounted on a portion of firearm 110, e.g., on a Picatinny rail, Weaver rail or dovetail mount. Referring to FIG. 2, optics mount 120 may have a mounting surface that is configured with a footprint onto which a device 200 in accordance with various proposed schemes of the present disclosure may be mounted.

Figure 3:
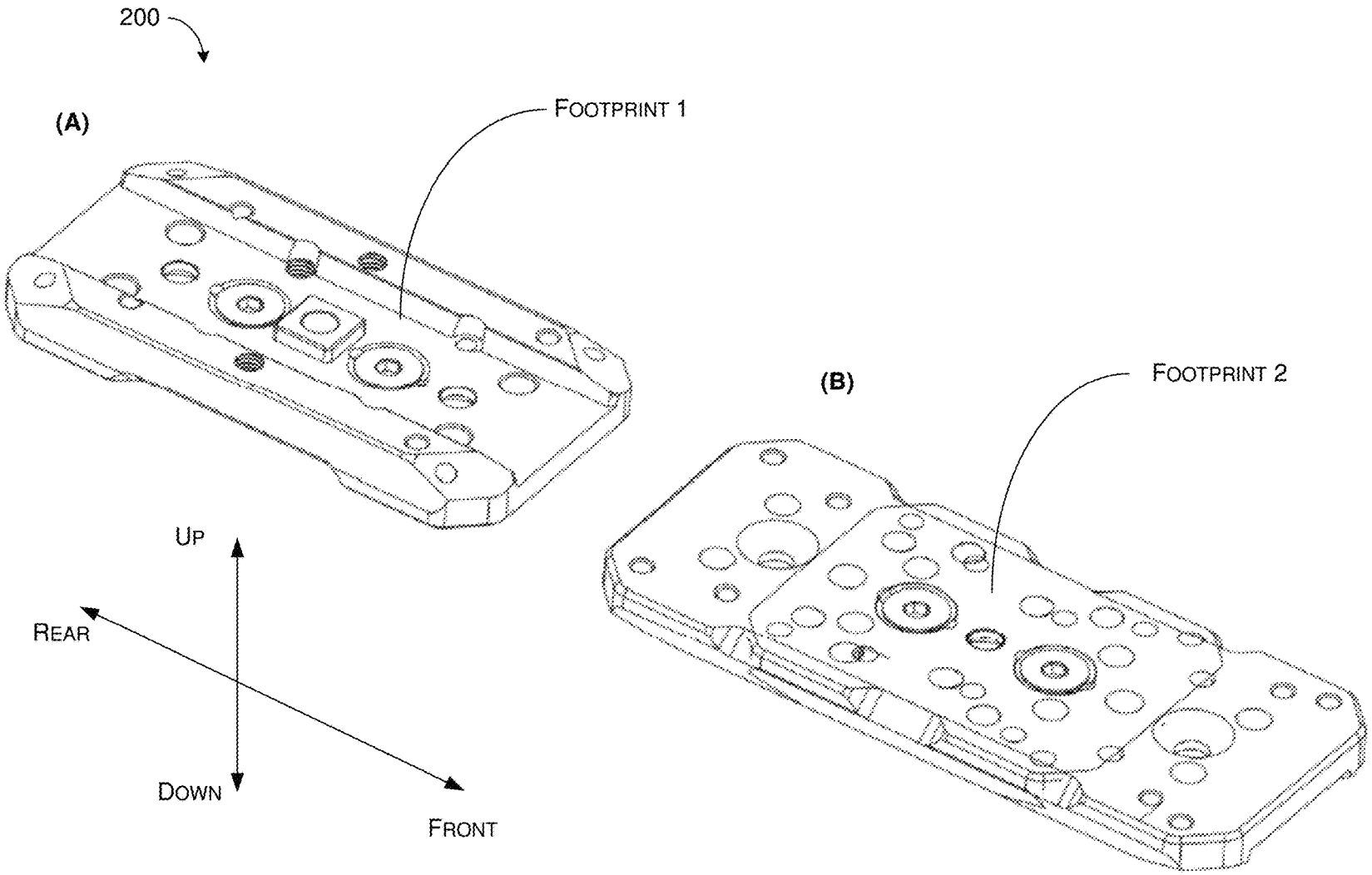
FIG. 3 is a diagram of an example implementation under a proposed scheme in accordance with the present disclosure.

FIG. 3 illustrates an example implementation of device 200 under a proposed scheme in accordance with the present disclosure. Referring to FIG. 3, device 200 may include a plate with a first primary side and a second primary side opposite the first primary side. Part (A) of FIG. 3 shows the first primary side of the plate of device 200 facing up, and part (B) of FIG. 3 shows the second primary side of the plate of device 200 facing up. Under various proposed schemes of the present disclosure, when installed in a first way with the first primary side facing a firearm (e.g., firearm 110 or another firearm) or an accessory of the firearm: (i) the first primary side may be configured to be directly mounted on a portion of the firearm or the accessory, and (ii) the second primary side may be configured to accommodate and mate with a first optic when the first optic is mounted on the second primary side of the plate. Moreover, when installed in second first way with the second primary side facing the firearm or the accessory of the firearm: (i) the second primary side may be configured to be directly mounted on the portion of the firearm or the accessory, and (ii) the first primary side may be configured to accommodate and mate with a second optic different from the first optic when the second optic is mounted on the first primary side of the plate.

Referring to part (A) of FIG. 3, a first footprint (denoted as "Footprint 1" in FIG. 3) of the first primary side may include one or more first patterns or features configured to accommodate and mate with the second optic. The one or more first patterns or features may include, for example, one or more first male posts, one or more first female holes, one or more first dovetail connections, one or more first indentations, one or more first protrusions, or a combination thereof.

Referring to part (B) of FIG. 3, a second footprint (denoted as "Footprint 2" in FIG. 3) of the second primary side may include one or more second patterns or configured to accommodate and mate with the first optic. The one or more second patterns or features may include one or more second male posts, one or more second female holes, one or more second dovetail connections, one or more second indentations, one or more second protrusions, or a combination thereof. Under various proposed schemes of the present disclosure, the first footprint and the second footprint may be different from each other.

Figure 4:
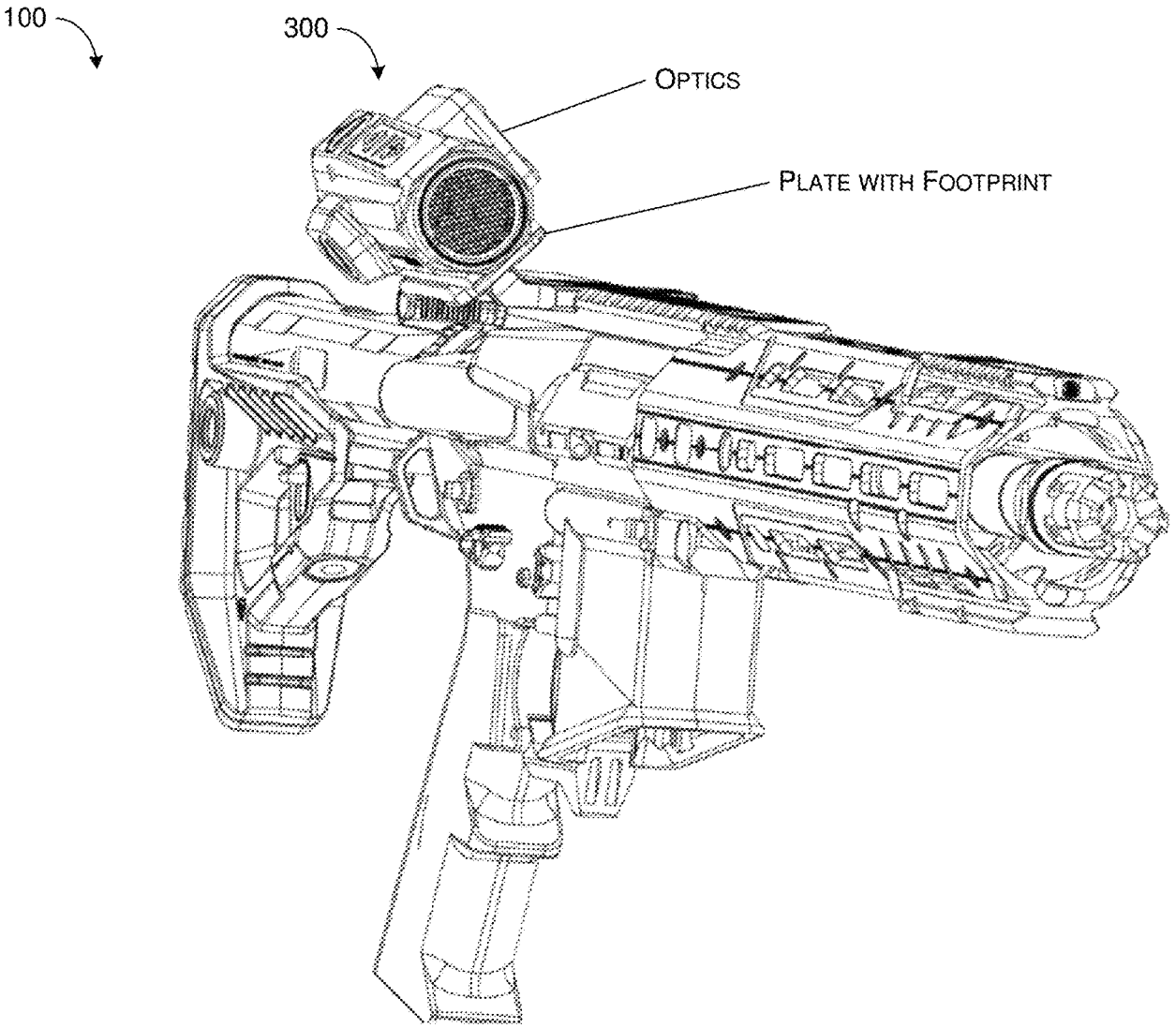
FIG. 4 is a diagram of an example implementation under a proposed scheme in accordance with the present disclosure.

FIG. 4 illustrates an example implementation under a proposed scheme in accordance with the present disclosure. Referring to FIG. 4, a first optic 300 (e.g., Aimpoint T-1 ™ or equivalent) may be mounted on the plate of device 200 which in turn may be mounted on optics mount 120 which in turn may be mounted on a portion (e.g., Picatinny rail, Weaver rail or dovetail mount) of the firearm.

Figure 5:
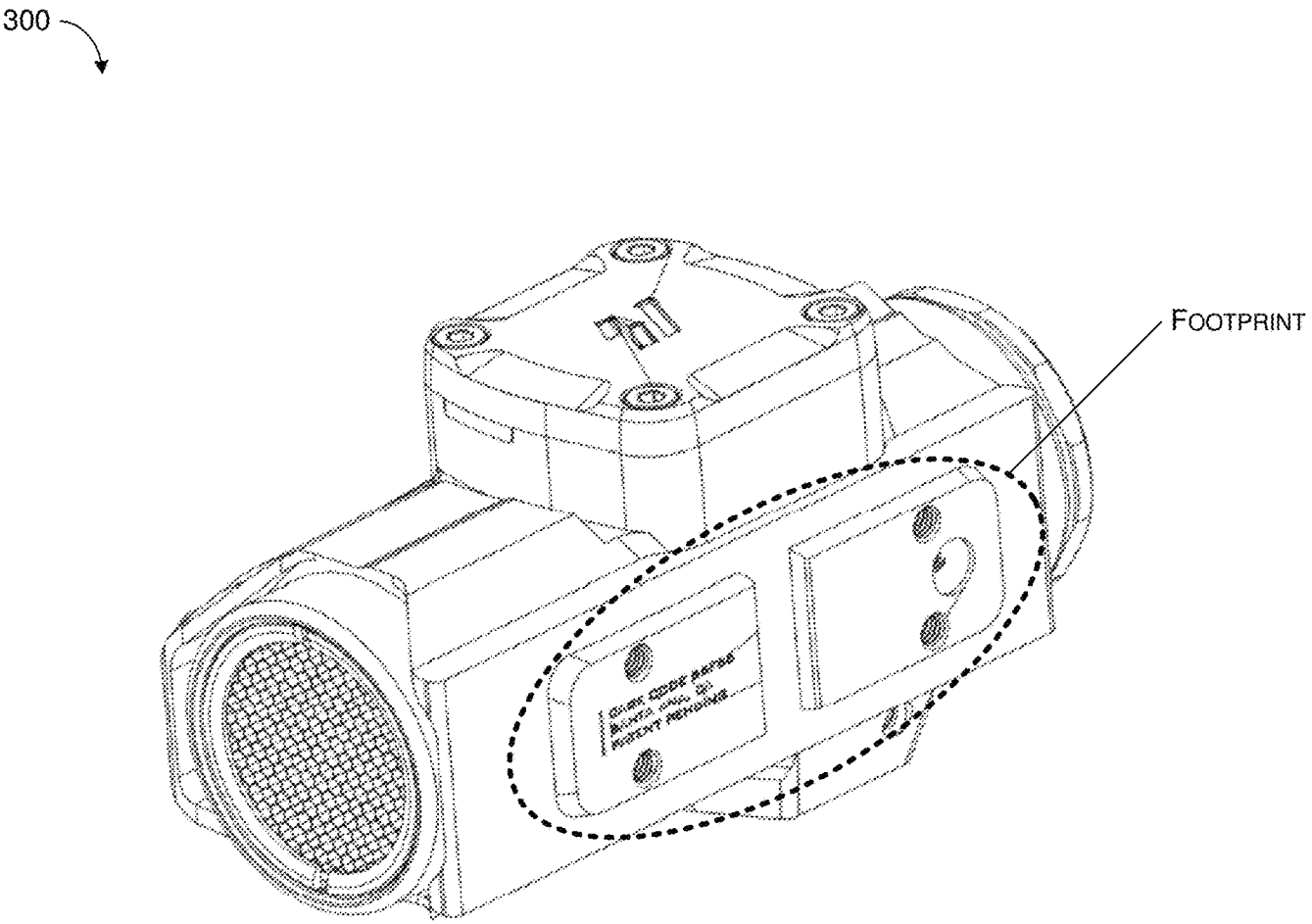
FIG. 5 is a diagram of an example implementation under a proposed scheme in accordance with the present disclosure.
Figure 6:
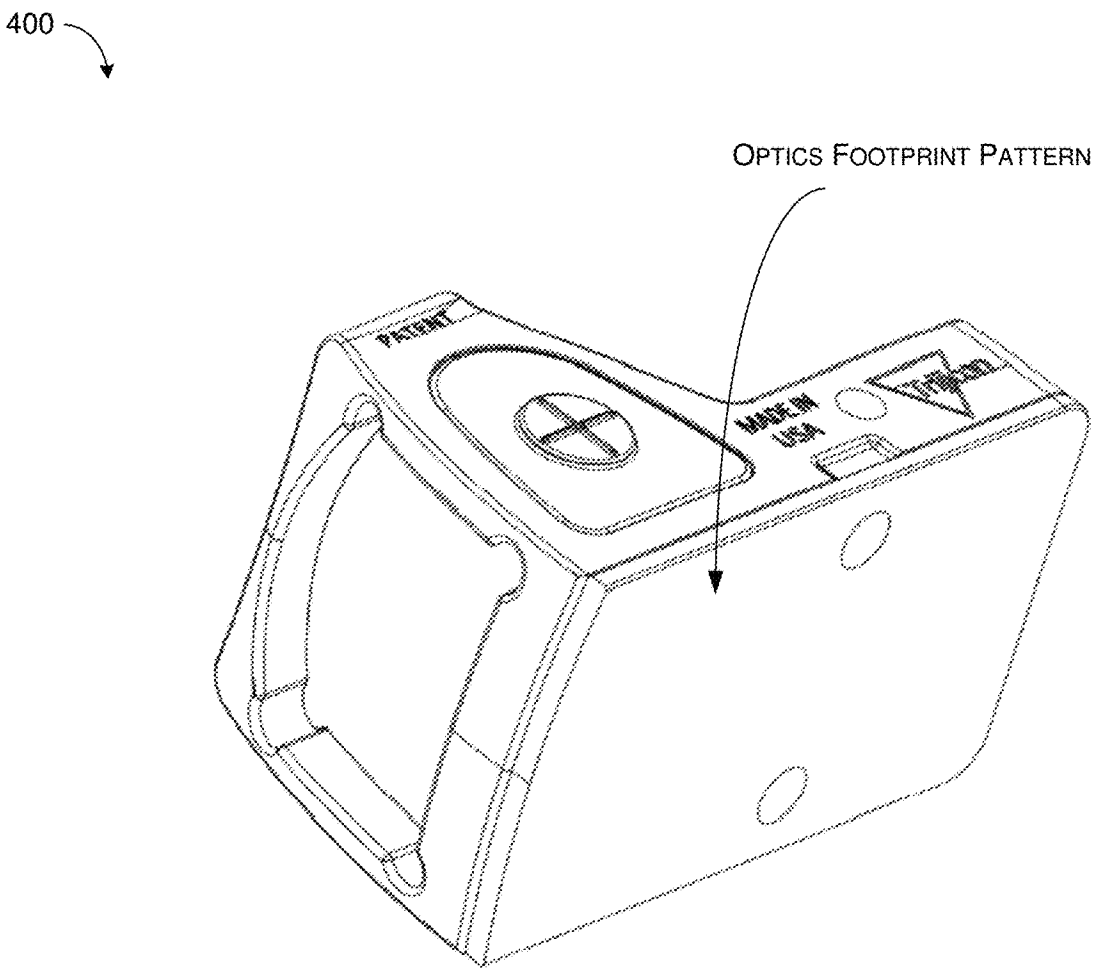
FIG. 6 is a diagram of an example implementation under a proposed scheme in accordance with the present disclosure.

FIG. 5 shows a mounting surface of first optic 300 with a footprint which mates with the first footprint (Footprint 1) of the first primary surface of the plate of device 200 when first optic 300 is mounted on the plate of device 200. FIG. 6 shows a mounting surface of a second optic 400 (e.g., Trijicon RMR®) which mates with the second footprint (Footprint 2) of the second primary surface of the plate of device 200 when second optic 400 is mounted on the plate of device 200.

Figure 7:
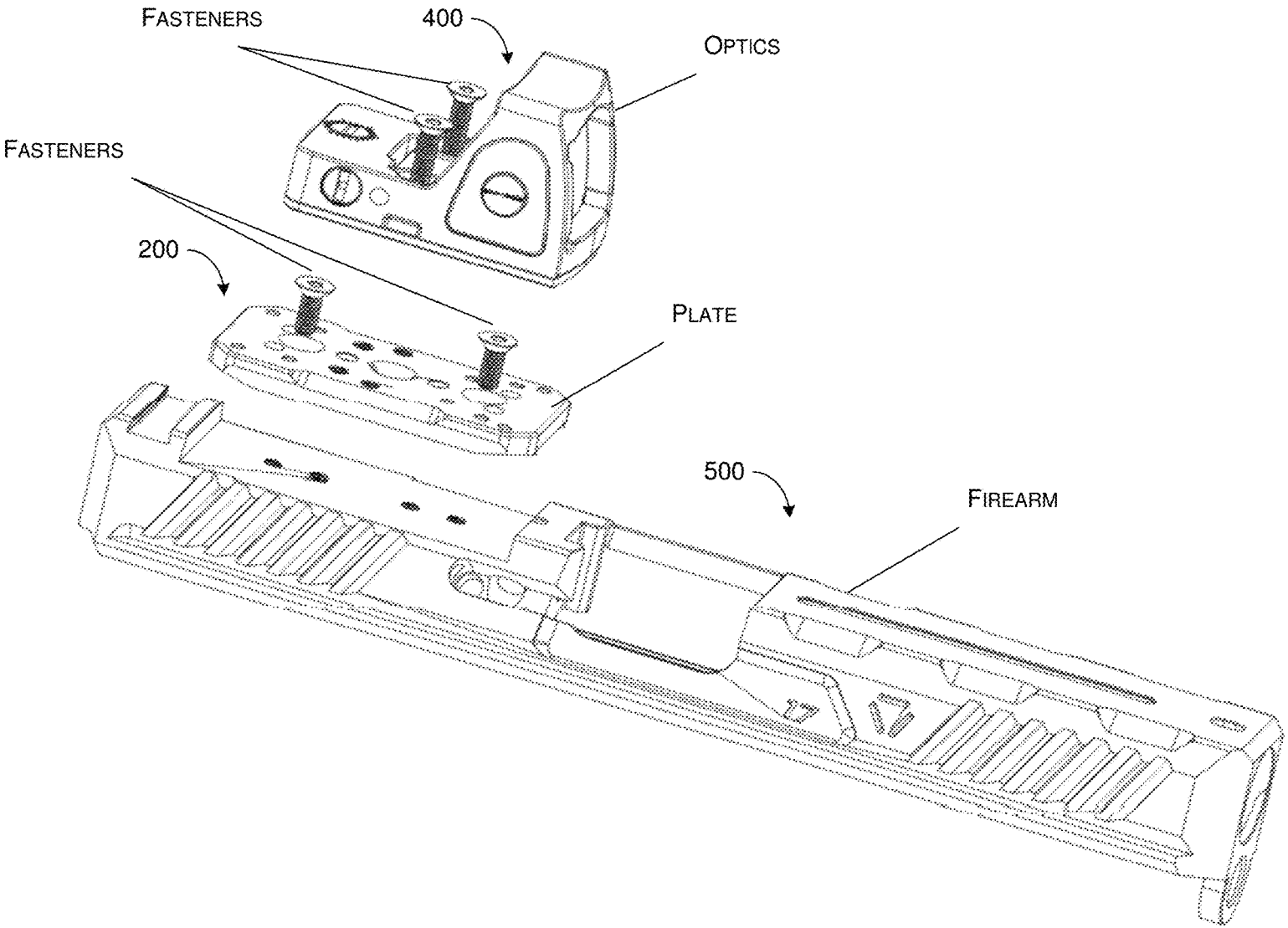
FIG. 7 is a diagram of an example implementation under a proposed scheme in accordance with the present disclosure.
Figure 8:
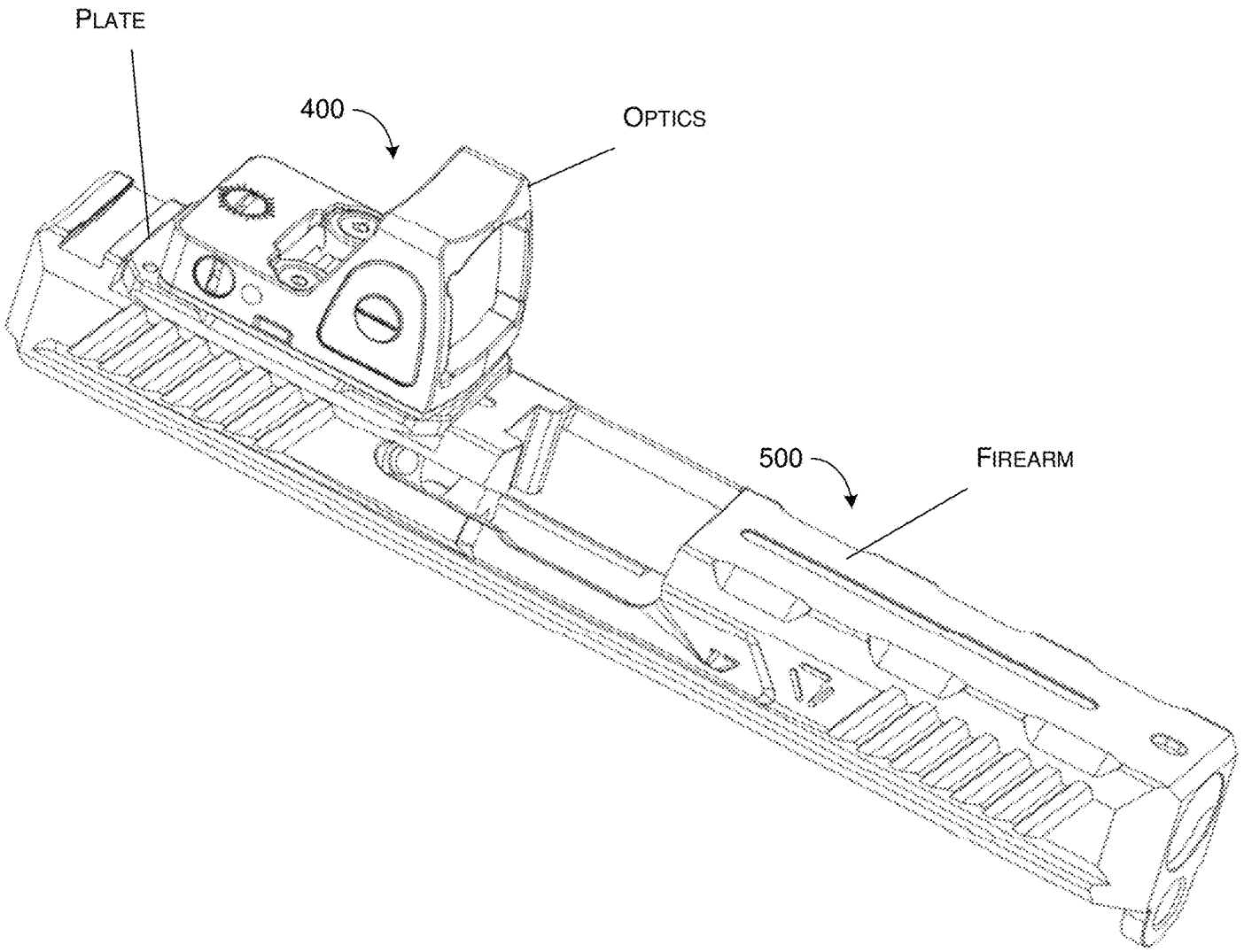
FIG. 8 is a diagram of an example implementation under a proposed scheme in accordance with the present disclosure.

Each of FIG. 7 and FIG. 8 illustrates an example implementation under a proposed scheme in accordance with the present disclosure. Referring to FIG. 7 and FIG. 8, in addition to the plate, device 200 may also include a securing mechanism configured to secure the plate on the portion of the firearm or the accessory of the firearm. For instance, the plate may be configured with one or more through holes and, in such cases, the securing mechanism may include one or more fasteners (e.g., screws) configured to traverse through the one or more through holes to secure the plate on the portion of the firearm (e.g., slide) or the accessory of the firearm. In the example shown in FIG. 7 and FIG. 8, device 200 may be mounted on a slide 500 of a slide assembly of a semiautomatic (or automatic) pistol, and second optic 400 may then be mounted on the plate of device 200 (e.g., by one or more additional fasteners) to secure second optic 400 on slide 500 of the firearm.

Figure 9:
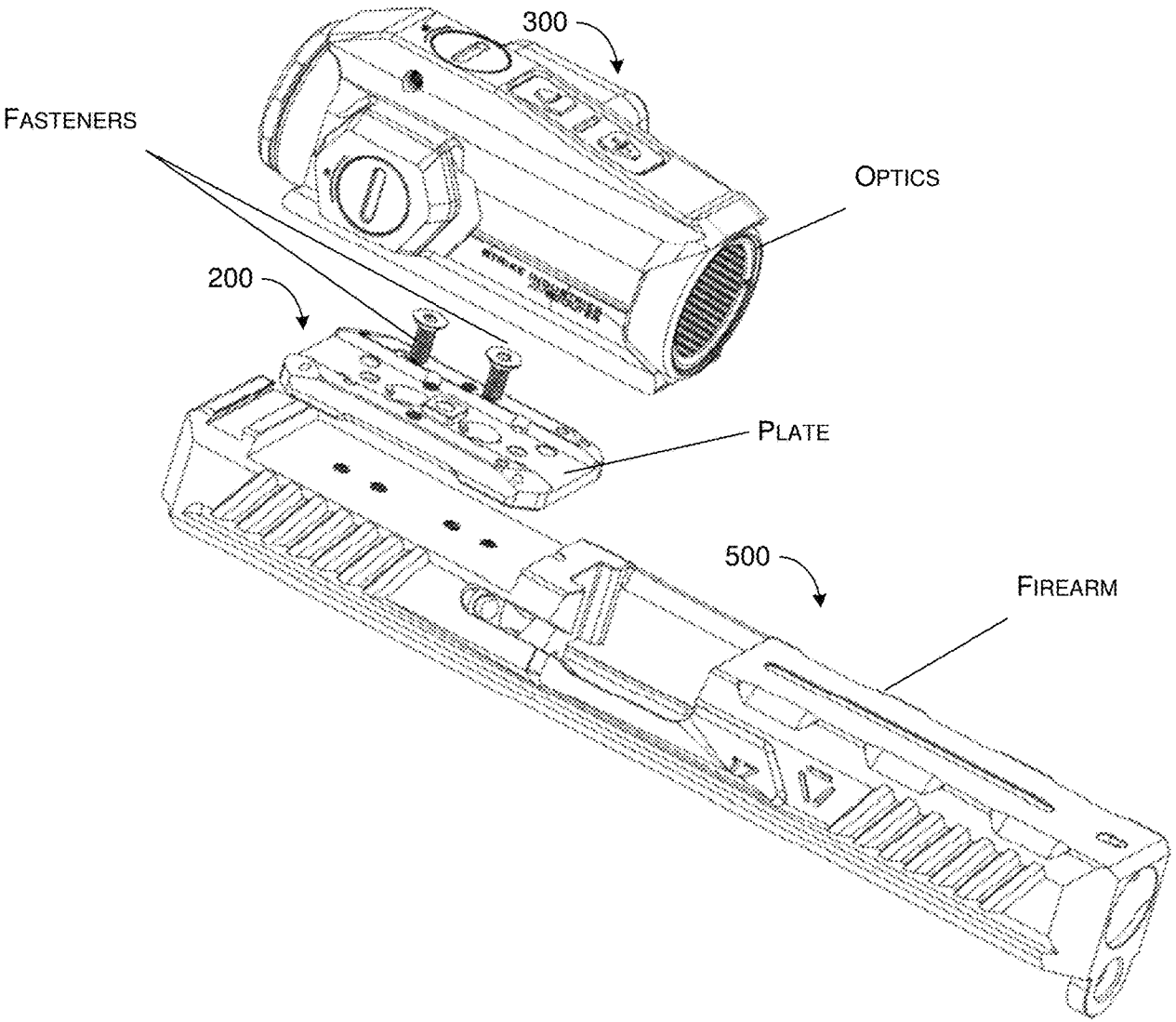
FIG. 9 is a diagram of an example implementation under a proposed scheme in accordance with the present disclosure.
Figure 10:
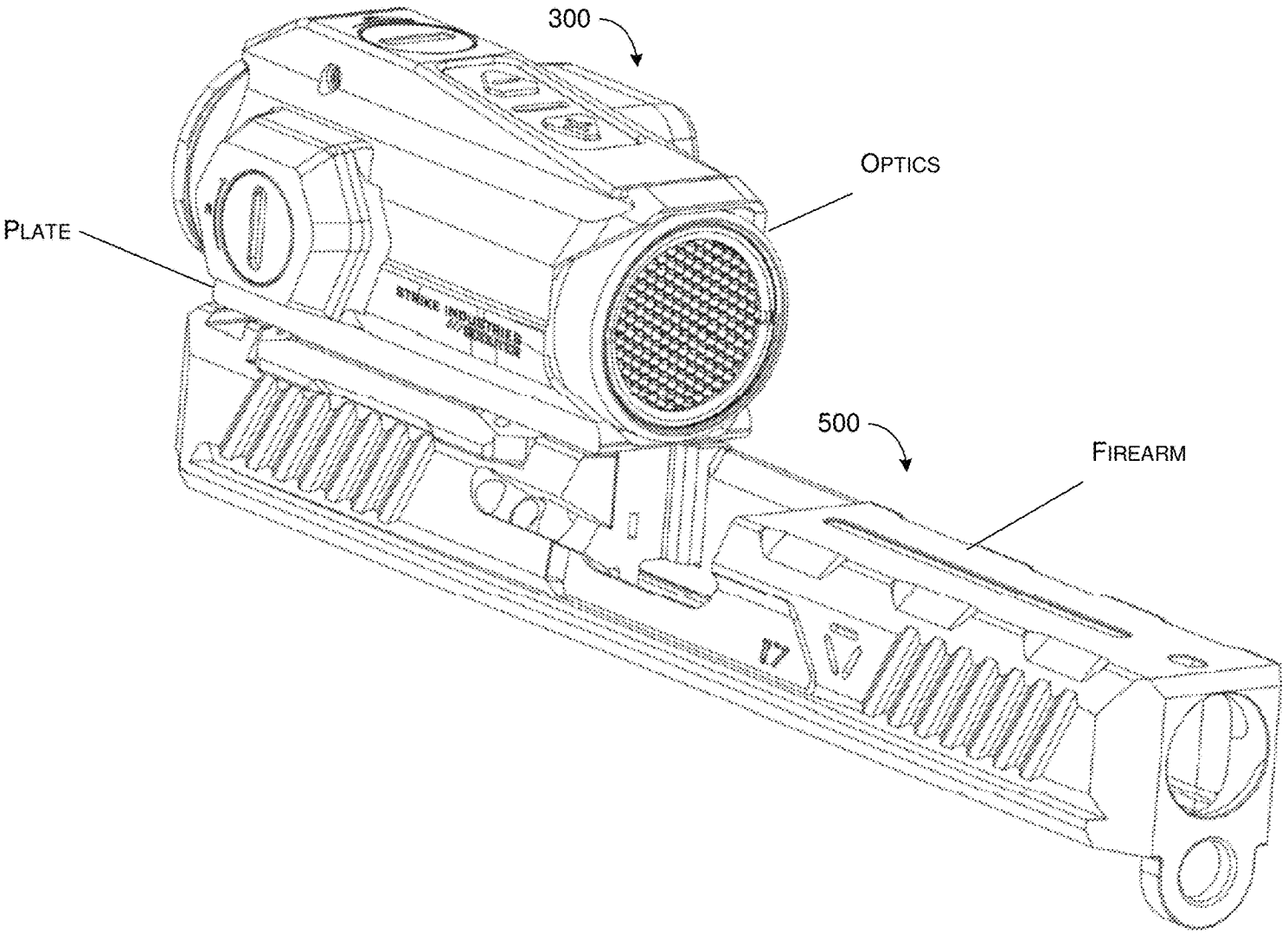
FIG. 10 is a diagram of an example implementation under a proposed scheme in accordance with the present disclosure.

Each of FIG. 9 and FIG. 10 illustrates an example implementation under a proposed scheme in accordance with the present disclosure. Referring to FIG. 9 and FIG. 10, in addition to the plate, device 200 may also include a securing mechanism configured to secure the plate on the portion of the firearm or the accessory of the firearm. For instance, the plate may be configured with one or more through holes and, in such cases, the securing mechanism may include one or more fasteners (e.g., screws) configured to traverse through the one or more through holes to secure the plate on the portion of the firearm (e.g., slide) or the accessory of the firearm. In the example shown in FIG. 7 and FIG. 8, device 200 may be mounted on a slide 500 of a slide assembly of a semiautomatic (or automatic) pistol, and first optic 300 may then be mounted on the plate of device 200 (e.g., by one or more additional fasteners) to secure first optic 300 on slide 500 of the firearm.

Highlight of Select Features

In view of the above, select features of various implementations in accordance with the present disclosure are highlighted below.

In one aspect, a device implementable on a plurality of firearms (e.g., AR-style or AK-style rifles, carbines, pistols or shotguns) may include a plate with a first primary side and a second primary side opposite the first primary side. When installed in a first way with the first primary side facing the firearm or an accessory of the firearm: (i) the first primary side may be configured to be directly mounted on a portion of the firearm or the accessory, and (ii) the second primary side may be configured to accommodate and mate with a first optic when the first optic is mounted on the second primary side of the plate. When installed in second first way with the second primary side facing the firearm or the accessory of the firearm: (i) the second primary side may be configured to be directly mounted on the portion of the firearm or the accessory, and (ii) the first primary side may be configured to accommodate and mate with a second optic different from the first optic when the second optic is mounted on the first primary side of the plate.

In some implementations, a first footprint of the first primary side may include one or more first patterns or features configured to accommodate and mate with the second optic. In some implementations, the one or more first patterns or features may include one or more first male posts, one or more first female holes, one or more first dovetail connections, one or more first indentations, one or more first protrusions, or a combination thereof.

In some implementations, a second footprint of the second primary side may include one or more second patterns or configured to accommodate and mate with the first optic. In some implementations, the one or more second patterns or features may include one or more second male posts, one or more second female holes, one or more second dovetail connections, one or more second indentations, one or more second protrusions, or a combination thereof.

In some implementations, the first footprint and the second footprint may be different from each other.

In some implementations, the portion of the firearm may include a slide of the firearm. In such cases, each of the first primary side and the second primary side may be configured to be mounted on the slide.

In some implementations, the accessory of the firearm may include an optics mount. In such cases, each of the first primary side and the second primary side may be configured to be mounted on the optics mount.

In some implementations, the device may also include a securing mechanism configured to secure the plate on the portion of the firearm or the accessory of the firearm. In some implementations, the plate may be configured with one or more through holes. In such cases, the securing mechanism may include one or more fasteners configured to traverse through the one or more through holes to secure the plate on the portion of the firearm or the accessory of the firearm.

In another aspect, a device implementable on a plurality of firearms (e.g., AR-style or AK-style rifles, carbines, pistols or shotguns) may include a plate with a first primary side and a second primary side opposite the first primary side. The first primary side may have a first footprint configured to accommodate and mate with a first optic. The second primary side may have a second footprint configured to accommodate and mate with a second optic. The first footprint and the second footprint may be different from each other.

In some implementations, the first footprint of the first primary side may include one or more first patterns or features configured to accommodate and mate with the second optic. In some implementations, the one or more first patterns or features may include one or more first male posts, one or more first female holes, one or more first dovetail connections, one or more first indentations, one or more first protrusions, or a combination thereof.

In some implementations, the second footprint of the second primary side may include one or more second patterns or configured to accommodate and mate with the first optic. In some implementations, the one or more second patterns or features may include one or more second male posts, one or more second female holes, one or more second dovetail connections, one or more second indentations, one or more second protrusions, or a combination thereof.

In some implementations, when installed in a first way with the first primary side facing the firearm or an accessory of the firearm: (i) the first primary side may be configured to be directly mounted on a portion of the firearm or the accessory, and (ii) the second primary side may be configured to accommodate and mate with a first optic when the first optic is mounted on the second primary side of the plate. When installed in second first way with the second primary side facing the firearm or the accessory of the firearm: (i) the second primary side may be configured to be directly mounted on the portion of the firearm or the accessory, and (ii) the first primary side may be configured to accommodate and mate with a second optic different from the first optic when the second optic is mounted on the first primary side of the plate.

In some implementations, the portion of the firearm may include a slide of the firearm. Moreover, each of the first primary side and the second primary side may be configured to be mounted on the slide.

In some implementations, the accessory of the firearm may include an optics mount. Moreover, each of the first primary side and the second primary side may be configured to be mounted on the optics mount.

In some implementations, the device may also include a securing mechanism configured to secure the plate on the portion of the firearm or the accessory of the firearm.

In some implementations, the plate may be configured with one or more through holes. In such cases, the securing mechanism may include one or more fasteners configured to traverse through the one or more through holes to secure the plate on the portion of the firearm or the accessory of the firearm.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a plate with a first primary side and a second primary side opposite the first primary side, wherein the plate is configured to be installed in a first way with the first primary side facing the firearm or an accessory of the firearm such that:

the first primary side is configured to be directly mounted on a portion of the firearm or the accessory, and the second primary side is configured to accommodate and mate with a first optic when the first optic is mounted on the second primary side of the plate, and wherein the plate is also configured to be installed in a second way with the second primary side facing the firearm or the accessory of the firearm such that:

the second primary side is configured to be directly mounted on the portion of the firearm or the accessory, and the first primary side is configured to accommodate and mate with a second optic different from the first optic when the second optic is mounted on the first primary side of the plate, wherein a first footprint of the first primary side and a second footprint of the second primary side are different from each other, wherein the first primary side is configured with at least one indentation that is not present on the second primary side, and wherein the second primary side is configured with at least one protrusion that is not present on the first primary side.

2. The device of claim 1, wherein the first footprint of the first primary side comprises one or more first patterns or features configured to accommodate and mate with the second optic.

3. The device of claim 2, wherein the one or more first patterns or features comprise a first male post, a first female hole, a first dovetail connection, a first indentation, or a first protrusion.

4. The device of claim 2, wherein the second footprint of the second primary side comprises one or more second patterns or configured to accommodate and mate with the first optic.

5. The device of claim 4, wherein the one or more second patterns or features comprise a second male post, a second female hole, a second dovetail connection, a second indentation, or a second protrusion.

6. The device of claim 1, further comprising:

a securing mechanism configured to secure the plate on the portion of the firearm or the accessory of the firearm.

7. The device of claim 6, wherein the plate is configured with one or more through holes, and wherein the securing mechanism comprises one or more fasteners configured to traverse through the one or more through holes to secure the plate on the portion of the firearm or the accessory of the firearm.

8. A device implementable on a firearm, comprising:

a plate with a first primary side and a second primary side opposite the first primary side, wherein the first primary side has a first footprint configured to accommodate and mate with a first optic, wherein the second primary side has a second footprint configured to accommodate and mate with a second optic different from the first optic, wherein the first footprint and the second footprint are different from each other, wherein the first primary side is configured with at least one indentation that is not present on the second primary side, and wherein the second primary side is configured with at least one protrusion that is not present on the first primary side.

9. The device of claim 8, wherein the first footprint of the first primary side comprises one or more first patterns or features configured to accommodate and mate with the second optic.

10. The device of claim 9, wherein the one or more first patterns or features comprise a first male post, a first female hole, a first dovetail connection, a first indentation, or a first protrusion.

11. The device of claim 9, wherein the second footprint of the second primary side comprises one or more second patterns or configured to accommodate and mate with the first optic.

12. The device of claim 11, wherein the one or more second patterns or features comprise a second male post, a second female hole, a second dovetail connection, a second indentation, or a second protrusiono.

13. The device of claim 8, wherein:

the plate is configured to be installed in a first way with the first primary side facing the firearm or an accessory of the firearm such that:

the first primary side is configured to be directly mounted on a portion of the firearm or the accessory, and the second primary side is configured to accommodate and mate with a first optic with the first optic is mounted on the second primary side of the plate, and the plate is also configured to be installed in a second way with the second primary side facing the firearm or the accessory of the firearm such that:

the second primary side is configured to be directly mounted on the portion of the firearm or the accessory, and the first primary side is configured to accommodate and mate with a second optic different from the first optic with the second optic is mounted on the first primary side of the plate.

14. The device of claim 8, further comprising:

a securing mechanism configured to secure the plate on the portion of the firearm or the accessory of the firearm.

15. The device of claim 14, wherein the plate is configured with one or more through holes, and wherein the securing mechanism comprises one or more fasteners configured to traverse through the one or more through holes to secure the plate on the portion of the firearm or the accessory of the firearm.

* * * * *